US005454778A

United States Patent [19]

Liaskos

[11] Patent Number: 5,454,778

[45] Date of Patent: Oct. 3, 1995

[54] APPARATUS FOR STIMULATING BLOOD CIRCULATION IN THE SCALP

[76] Inventor: Nikolaos Liaskos, Reinickendorfer Strasse 61, 13347 Berlin, Germany

[21] Appl. No.: 287,832

[22] Filed: Aug. 9, 1994

Related U.S. Application Data

[63] Continuation-in-part of Ser. No. 80,369, Jun. 21, 1993, abandoned.

[30] Foreign Application Priority Data

Jun. 23, 1992 [DE] Germany ..... 42 20 697.9

[51] Int. Cl.[6] ..... A61H 9/00

[52] U.S. Cl. ..... 601/12; 601/7; 604/315

[58] Field of Search ..... 601/6, 7, 10, 11, 601/12, 46; 128/205.14, 205.19, 207.15; 604/27, 74, 315; 73/149

[56] References Cited

U.S. PATENT DOCUMENTS

| | | | |
|---|---|---|---|
| 1,821,979 | 9/1931 | Lowen | 601/12 |
| 2,078,536 | 4/1937 | Hardman | 601/7 |
| 2,123,418 | 7/1938 | Crosley et al. | 601/12 |
| 2,338,339 | 1/1944 | Mere et al. | 604/315 X |
| 4,292,971 | 10/1981 | Smit et al. | 604/315 X |
| 4,469,092 | 9/1984 | Marshall et al. | 604/315 X |
| 4,502,482 | 3/1985 | DeLuccia et al. | 128/207.15 |
| 4,748,973 | 6/1988 | Cho | 601/10 |
| 4,836,192 | 6/1989 | Abbate | 601/12 X |
| 4,857,051 | 8/1989 | Larson | 604/74 |
| 5,228,431 | 7/1993 | Giarretto | 601/12 X |

FOREIGN PATENT DOCUMENTS

| | | | |
|---|---|---|---|
| 0848234 | 9/1952 | Germany | 601/12 |
| 0440351 | 6/1949 | Italy | 601/12 |

*Primary Examiner*—Joe H. Cheng

[57] ABSTRACT

An apparatus for increasing the blood circulation in the scalp is provided, having a vacuum, a flexible tube, and a rigid, elastic suction funnel, the flexible tube being connected at one end thereof to the vacuum and at the other end thereof to the funnel, the funnel having a small opening at one thereof for connection to the tube and having a large opening at the other end thereof, the large opening having an edge adapted for application to the scalp. The funnel is transparent to allow for observation of the scalp therethrough, the funnel having a pair of rigid parallel rings situated thereon, one located near the small opening and one located near the large opening, and a longitudinal rod being attached between the pair of rigid rings, the longitudinal rod being provided with spaced markings so that changes in the level of the scalp may be observed during operation of the apparatus.

2 Claims, 2 Drawing Sheets

APPARATUS FOR STIMULATING BLOOD CIRCULATION IN THE SCALP

This application is a continuation-in-part of U.S. Ser. No. 08/080,369, filed Jun. 21, 1993, now abandoned.

BACKGROUND OF THE INVENTION

The present invention relates to an apparatus for increasing blood circulation in the skin, particularly the human scalp. In particular, this invention relates to an apparatus for applying vacuum pressure to the scalp of a human male to increase the bloodflow and thereby producing the conditions stimulate the growth of hair.

There are many theories which attempt to explain the loss of hair on the head among human males. Changes in metabolism and in the amount of hormones, as well as other factors appear to have a significant effect on the scalp. As is well known, every hair has a root or hair bulbous, which is located deep inside the scalp tissue. The skin layer known as the subcatis contains in addition to fat cells the fat glands. Above the subcatis is the lorium, which contains blood vessels, nerve cells and sense organs. Above the lorium lies the epidermis which is 0.5 to 2 mm thick.

The hairs grow from inside to the outside of the scalp. The hair roots are fed from inside through blood vessels, which provide them with oxygen and building materials, and act to remove the nourishing materials used by the hair building cells during growth. The supply of blood is an absolute necessity for the growth of hair.

The hairs on the head of a human male generally have a lifetime of from five to seven years. Consequently, from each hair root about ten to twelve new hairs will sprout during a male's lifetime. This hair growth cycle has three phases: (a) the growth phase (anagenic) lasts from five to seven years, (b) the transitional phase (katagenic) lasts from one to two weeks, and (c) the rest phase (telogenic) last two to four months.

The significance of blood circulation during the growth phase is well known. According to histochemic examinations of the blood vessels, it is known that during the katagenic phase, the number of vessels in the immediate vicinity of the bulbous is reduced, while at the onset of the anagenic phase the blood circulation and microcirculation increases.

In order to promote blood circulation in the hair roots of the human male, an apparatus has been developed which can mechanically treat confined areas on the scalp. By means of a vacuum producing apparatus, small areas of the scalp are exposed to a suction effect produced by a vacuum. However, this apparatus has the disadvantage that only areas smaller than the entire dimension of the scalp can be treated. This is because the vacuum contact ends can only be effective when the edges thereof sit firmly and tightly on the surface being treated.

Another apparatus has been proposed which attempts to use a vacuum helmet placed on the head. While the desired effect of increasing blood circulation in the scalp can be attained, there are difficulties encountered. The device works slowly, and requires many different size helmets to accommodate the different sized head shapes of various users. Furthermore, the sealing material proposed for the edges of the helmet requires great attention and care by the user in order to function properly.

The present invention aims to promote the circulation of blood in the scalp, especially in the vicinity of the hair roots.

A further aim is to make possible the treatment of large areas of the scalp through intensive blood circulation by a simple apparatus which is easy to use and inexpensive to manufacture. A still further aim to provide an apparatus which allows for the careful observation of the scalp during operation to gauge the reaction of the scalp to the pressure being applied.

SUMMARY OF THE INVENTION

These tasks are achieved through the creation of an apparatus according to the present invention, which comprises a means for producing a vacuum or strong underpressure coupled with a means for transmitting the suction effect of the vacuum to the scalp. The vacuum producing means should be variable to produce differing underpressures according to individual need. A tube or other connecting means communicates the vacuum producing means to the small end of a funnel-shaped suction end, also referred to as a funnel. The large opening of the suction end has an edge adapted for tight mounting on the scalp. The edge is provided with a self-acting, sticking profile. The funnel-shaped suction end may be made of an elastic material to aid in securing a tight fit against the scalp. Alternatively, only the edge portion may be made of an elastic material.

The connecting tube is preferably elastic, and attaches to the suction end and the vacuum producing means by way of standard airtight, pressure resistant connectors. The small opening of the suction end may be provided with a nozzle which mates with a corresponding connector on the tube. In addition, several suction ends of differing sizes may be provided, each with a standard size nozzle for mating with a common tube end.

The funnel is made of a transaparent material to allow the user to observe changes in the scalp during the application of pressure. Furthermore, a measuring gauge is provided on the side of the funnel, preferably along with a magnifying lens, so that the degree of swelling in the scalp can be accurately measured.

By using the claimed apparatus, an intensive, speedy and effective treatment of the scalp may be offered to those human males experiencing a loss of hair. The suction end of the invention is of such a dimension to enable treatment of an area about the size of the palm of the hand. The suction end can be moved about after a period of time to enable treatment of large areas of the scalp, while ensuring a tight fit at each area of application. This size also enables the suction end to adapt to different size head shapes. An additionally advantageous embodiment employs two or more suction ends applied simultaneously to different areas of the scalp, by way of a vacuum producing means having an outlet for two or more tube/suction end combinations, or a single tube having a splitting means for branching off into two or more ends for attaching to two or more suction ends.

The claimed apparatus helps to achieve an immediate interruption of the hair loss process under normal circumstances. After the first treatment, invigoration of the hair roots and growth of new hairs begins to take place. This effect is not immediately visible, but becomes so after a few weeks of treatment. It has been found that daily treatment is not required, rather a period of three to five days between treatments can be effective. However, this will vary with the individual. Treatment of a particular area may last for a period of approximately one minute or less, with the process being repeated throughout the scalp as needed.

DETAILED DESCRIPTION OF THE INVENTION

Figure 1:
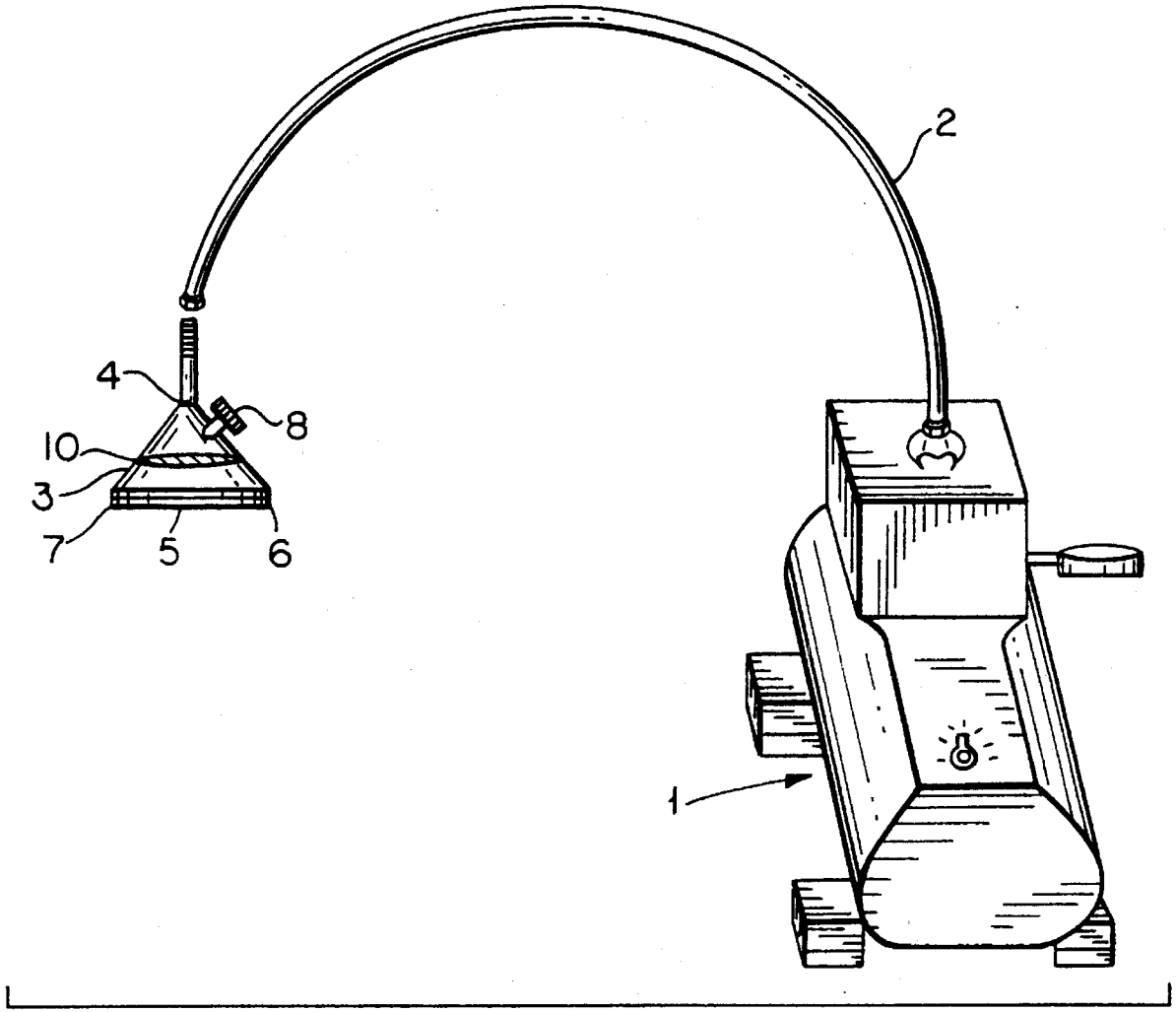
FIG. 1 is a schematic drawing of the apparatus of the invention.
Figure 2:
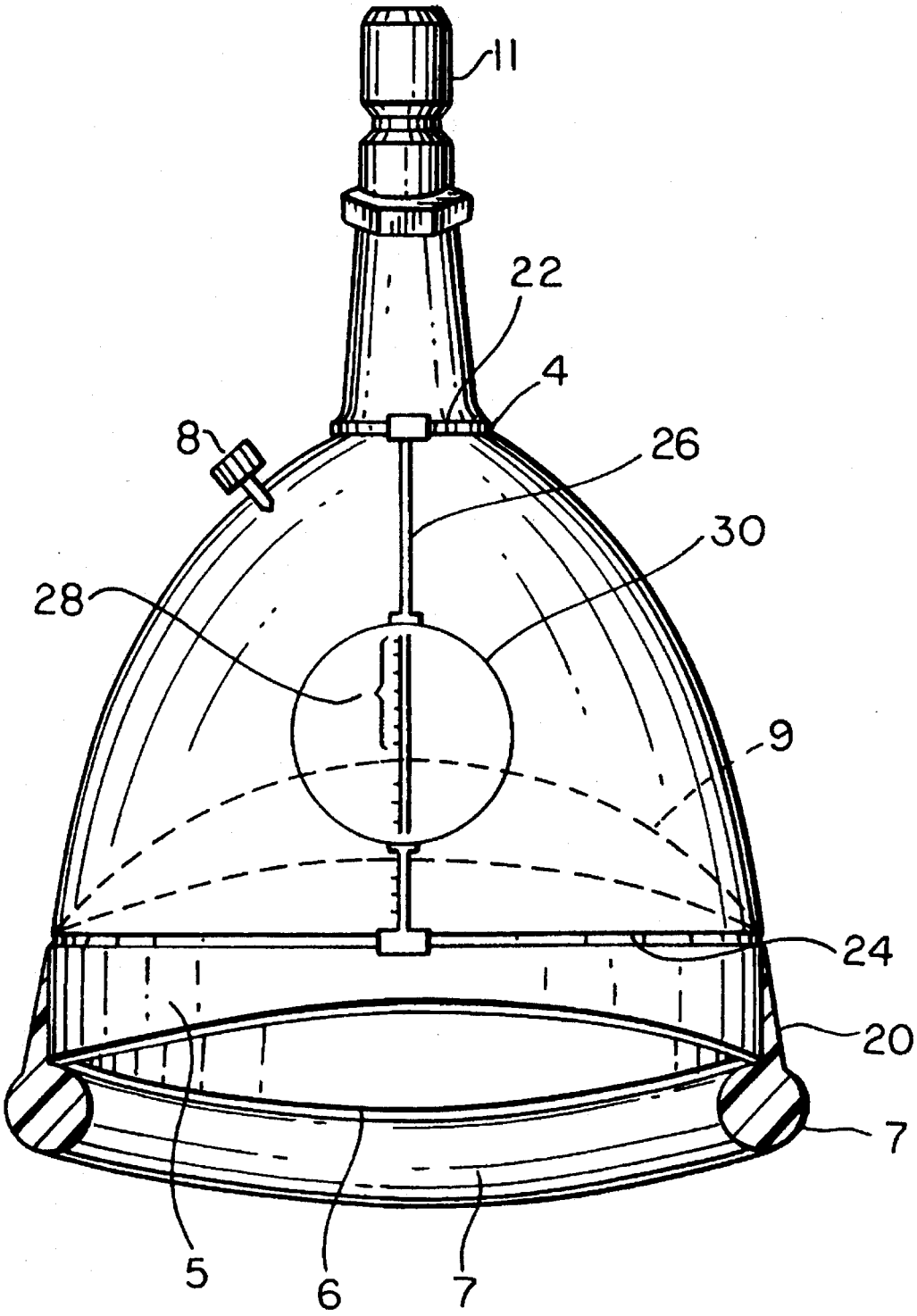
FIG. 2 is a front elevational view, with partial cross-section, of the funnel of the apparatus of the invention.

A vacuum producing means 1 is provided, and may be for example either of the following, although one skilled in the art will appreciate that other types of vacuum pumps will be effective: (1) A non-oil vacuum pump, 220 V, 50 Hz, flow rate of 1.2 $m^3$/hr, max pressure 0.8 bar, max. vacuum 75% and 250 mbar, motor power 0.045 kW, 2780 speed rpm, or (2) Oil type vacuum pump, 220 V, 50 Hz, 240 W, Ph 1, 2.5 $m^3$/hr, micr., 2800 speed rpm. A flexible connecting tube 2 is connected at a first end 20 to the vacuum means 1, and at its other end to the small opening 4 of a suction funnel 3. The small opening 4 of the funnel 3 may have a nozzle 11 for mating with a corresponding attachment means on the first end 20 of the tube 2. Different size suction ends may be provided, however, it is preferred that they all have an identical size mating means so that only a single tube of the apparatus may be employed at all times. In general, all points of connection in the apparatus may be made with standard connecting devices, so long as such devices are air-tight and sufficiently pressure resistant.

The large opening 5 of the suction end is the part of the apparatus which contacts the scalp, and is made to be tightly mountable on the portion thereof to be treated. The edge 6 of the large opening may be rounded to provide comfort. Alternatively, the edge 6 may be provided with a sealing element 7 for comfort, and to ensure a close air-tight fit at the point of contact with the scalp. The sealing element 7 may comprise a self-acting, sticking profile element.

The funnel 3 may be manufactured of an elastic material to provide comfort and improved mating with the scalp. This effect can also be achieved by providing a funnel having only the edge 6 or the portion of the funnel immediately adjacent the edge being of an elastic material.

In order to regulate the amount of pressure being applied to the scalp, the vacuum means should have a regulating means. Alternatively, a regulating (manual or automatic) valve 8 may be provided in the apparatus, for example, at a connecting point of the tube, or as part of the suction end itself, as shown in the drawing. A manometer or power regulator may also be employed to adjust the pressure.

It is also advantageous to provide a filtering means to trap foreign objects drawn into the apparatus, and prevent such objects from entering the vacuum means. A filter 10, such as one similar to a motorcycle engine fuel filter, may be situated as part of the suction end, at a connection point, or at a location along the length of the tube.

To utilize the apparatus, the edge 6 of large opening 5 of the funnel 3 is placed on the area of the scalp to be treated, and pressure is applied by hand to force the edge 6 against the scalp. The vacuum means is turned on so as to apply a vacuum or strong underpressure to the scalp. After a short period, generally one minute or less, the vacuum means is turned off, and the funnel is applied to a different area of the scalp for treatment. The process is repeated until all required areas of the scalp have been treated. The entire process may be repeated every day or up to once every three to five days. It should be recognized that the pressure, duration, and regularity of treatment may be varied by the individual to achieve optimal results.

The application of pressure to the scalp by way of the funnel will cause increased circulation to the effected area as well as swelling. It is important that too much swelling not be permitted to occur, as this could result in pain or damage to the scalp. Accordingly, the present invention provides for the funnel 3 to be made of a transparent material, so that the scalp can be carefully observed during the application process, without having to remove the funnel and interrupt the process. In addition, the use of a transparent funnel allows the user to accurately position the funnel on the portion of the scalp in need of treatment.

The transparent funnel should be rigid and strong, while at the same time being elastic. This will allow proper positioning and a tight fit on the scalp, the shape of which generally changes over its surface. The self-acting elastic cylindrical ring 7 adjacent the large opening 5 of the funnel 3 contacts and conforms to the scalp to form a seal against the scalp. The ring may be preferably attached to the large opening by-way of a strip 20 secured to the outside edge of the large opening 5 of the funnel 3. The strip 20 acts to firmly secure the ring 7 to the funnel 3, especially during the initial application of vacuum pressure, which causes the ring 7 to bend inwards.

The transparent funnel 3 is provided with two parallel rigid rings, one 22 near the small opening 4 and one 24 near the large opening 5. A thin rod 26, separate from the funnel, is directly attached longitudinally between the two rigid rings 22,24. This arrangement allows for the rod to remain in position regardless of any elastic movement of the funnel during operation. Reference marks 28 may be present along the length of the rod, so that a measurement of the movement of the scalp 9 due to the vacuum pressure and/or swelling may be observed. In addition, a magnifying lens 30 may be located on the rod 26 so that measurements may be made more accurately. The lens 30 may be movably secured to the rod 26, so that movement along the rod 26 may be achieved.

It is recommended that harsh soaps be avoided, which may have the tendency to wash away the natural oils that are helpful in growing hair. Rather, the scalp should be wiped once or twice a day with a clean towel or soft thin tissue paper. In addition, a skin cream should be used immediately on the scalp after use of the apparatus.

What is claimed is:

1. An apparatus for increasing the blood circulation in the scalp, comprising a vacuum producing means, a flexible tube, and a rigid, elastic suction funnel, the flexible tube being connected at one end thereof to the vacuum producing means and at the other end thereof to the funnel, the funnel having a small opening at one end thereof for connection to the tube and having a large opening at the other end thereof, the large opening having an edge adapted for application to the scalp, the large opening being of a diameter such that it covers only a portion of the scalp, wherein the funnel is transparent to allow for observation of the scalp therethrough, the funnel having a pair of rigid parallel rings situated thereon, one located near the small opening and one located near the large opening, and a longitudinal rod being attached between the pair of rigid rings, independently of the funnel, the longitudinal rod being provided with spaced markings so that changes in the level of the scalp are observable during application of the apparatus thereto.

2. The apparatus of claim 1, wherein a magnifying lens is provided on the longitudinal rod, said lens being movable along the length of the longitudinal rod.

* * * * *